US005467834A

United States Patent [19]

Hughes et al.

[11] Patent Number: 5,467,834

[45] Date of Patent: Nov. 21, 1995

[54] METHOD AND APPARATUS FOR SHORT RADIUS DRILLING OF CURVED BOREHOLES

[75] Inventors: W. James Hughes; James W. McCabe, both of Tulsa; Owen L. Marks, Jr., Wagoner, all of Okla.

[73] Assignee: Maverick Tool Company, Tulsa, Okla.

[21] Appl. No.: 287,501

[22] Filed: Aug. 8, 1994

[51] Int. Cl.[6] ..... E21B 7/08

[52] U.S. Cl. ..... 175/61; 175/74; 175/76; 175/325.1

[58] Field of Search ..... 175/61, 73, 75, 175/76, 325.1, 325.3, 325.2

[56] References Cited

U.S. PATENT DOCUMENTS

| | | | |
|---|---|---|---|
| 4,185,704 | 1/1980 | Nixon, Jr. | 175/76 |
| 4,416,339 | 11/1983 | Baker et al. | 175/61 |
| 4,615,401 | 10/1986 | Garrett | 175/325.2 |
| 4,638,873 | 1/1987 | Welborn | 175/325.2 X |
| 4,770,258 | 9/1988 | Falgout, Sr. | 175/73 |
| 5,181,576 | 1/1993 | Askew et al. | 175/76 X |
| 5,293,945 | 3/1994 | Rosenhauch et al. | 175/73 X |

FOREIGN PATENT DOCUMENTS

| | | | |
|---|---|---|---|
| 646129 | 8/1962 | Canada | 175/73 |
| 1599520 | 10/1990 | U.S.S.R. | 175/76 |

*Primary Examiner*—Ramon S. Britts
*Assistant Examiner*—Frank S. Tsay
*Attorney, Agent, or Firm*—William S. Dorman

[57] ABSTRACT

A method and apparatus for the drilling of the curved borehole portion of a horizontal or directional well. A tight radius of curvature is rotary drilled by use of flexible composite drilling pipe or other flexible pipe common to the industry which terminate within an eccentric collar on the final drill string section. The eccentric collar is equipped with a retractable and grooved compression pad which expands outwardly to hold the eccentric collar (which is also grooved on its opposite side) against the side of the well bore to prevent the eccentric collar from rotating during the rotary drilling process. The final drill string section connects to a lower drill bit collar and rotary drill bit through a driving ball and socket connection. The eccentric collar on the final drill string section that engages the well bore forces the deflection of the drill bit about the ball and socket connection and holds this orientation as the rotating drill proceeds forward. Such a technique can achieve a radius of curvature of less than twenty feet.

16 Claims, 9 Drawing Sheets

METHOD AND APPARATUS FOR SHORT RADIUS DRILLING OF CURVED BOREHOLES

BACKGROUND OF THE INVENTION

1. Field of the Invention

This invention relates to a method and apparatus for the drilling of the curved borehole portion of a horizontal or directional well. More specifically, but not by way of limitation, this invention relates to the drilling of short radius curved boreholes.

2. The Prior Art

It is generally known that the final portion of a rotary drilling string (the so-called drilling collar) or the like is under compressive loads and torque during drilling, while the upper portion of the drilling string is under tension. As such, the weight of the drill collar below the point of last contact with the borehole wall may be thought of as being divided into two components; one acting along the axis of the collars and the second acting normal to the first, perpendicular to the borehole.

It is also generally known that, in principle, if the downhole orientation and magnitude of the normal force could be controlled during drilling, the drill bit could essentially be steered to any desired subsurface location or strata. Although theoretically possible and highly desirable, such a process and corresponding drilling equipment to achieve such a goal have not yet been developed. However, various processes and associated equipment have been employed that generally achieve varying degrees of what is recognized in the art as directional drilling. For example, it is common practice in oil and gas well drilling to use a so-called "whipstock" (a sloped plug inserted below the drill bit) to intentionally deflect the drill bit in a desired direction, thus creating a deviation in the direction of drilling.

It is also common practice in oil and gas well drilling to employ equipment and methods to minimize or eliminate the effect of the force normal to the bore hole such as to maintain the drilling in a vertical line. Thus, various types of drilling collars, stabilizers and the like have been proposed to keep the drilling process proceeding uniformly in one direction. For example, U.S. Pat. Nos. 3,145,758 and 4,319,649 disclose drill collar stabilizers to maintain the drilling in a straight line.

In U.S. Pat. No. 4,220,213 an eccentric member having a heavy, thick walled side and a lighter, thin walled side is placed concentrically about the drill bit collar or a rigid drill string with an offset projection on the outside of the eccentric member positioned usually 90 degrees to the right of the heavy, thick walled portion. In this manner, gravity will cause the heavy, thick walled portion of the eccentric collar to rotate to the underside or low side of a deviating drill string, thus positioning the projection such as to alleviate or compensate for the undesirable "walking" of the drill bit. In other words, an eccentric tumbler member rotatably supported on the drill string is used to prevent the drill bit from moving laterally and the resulting normal force continuously restores the hole to vertical.

Various types of drilling collar stabilizers have also been proposed to alter the direction of drilling. For example, U.S. Pat. Nos. 4,305,474 and 4,465,147 disclose stabilizers that create a deflecting force perpendicular to the drill string in order to control and guide the drill bit along a desired course of direction. Also, the use of an eccentric stabilizer has been proposed in U.S. Pat. No. 4,076,084 to drill a directionally oriented hole such as commonly practiced when drilling from an offshore platform or the like.

One particularly difficult type of drilling process to control is the so-called lateral or horizontal drilling. Unlike the concept of directional drilling wherein radii in terms of hundreds of feet and deviations up to one to two miles are to be achieved relative to the surface location of the drilling platform or drilling rig, the concept of lateral drilling involves creating a highly curved well bore usually as an offshoot from a pre-drilled well bore. Thus, for example, in U.S. Pat. No. 4,402,551 a whipstock is employed to drill short radius horizontal holes below a vertical cased well bore. It is acknowledged in this patent that current, state-of-the-art techniques limit the smallest radius of curvature for surface drilling to 19 feet (i.e., 3 degrees of deflection per foot over 30 feet of linear drilling) to produce a horizontal drainhole at depths greater than 2,000 feet.

Part of the difficulty in lateral drilling was the elimination or reduction in the spiral effect that was caused by the drill bit turning to the right. This problem was first fully addressed in U.S. Pat. No. 2,712,434 whereby a non-rotating eccentric sleeve was used in conjunction with a bushing latch type mechanism which allowed the orientation back to the desired position after the drill bit had wandered off the desired track. In an attempt to maintain a constant heading, U.S. Pat. Nos. 4,739,843 and 4,699,224 addressed the problem of poor orientation control by using the aforementioned non-rotating eccentric sleeve and adding spring-loaded blades attached in order to grip the wellbore and to maintain orientation as the drilling assembly is advanced. It was advocated in these patents that periodic repositioning of the blades be accomplished so that a planar curve could be drilled.

Although the prior art has achieved some degree of success in drilling a tight radius or curvature, the failure to develop a commercial apparatus to date has been: (1) the radius of curvature is inconsistent, (2) the ball/pin flexible joint is weak and could fail under normal operating conditions, (3) maintaining the desired orientation of deflection is difficult, (4) the constant engagement of spring-loaded blades can cause multiple problems ranging from misorientation to sticking in the hole. In spite of previous efforts in the prior art, an acceptable method for drilling a tight radius of curvature without unacceptable deviation out of the plane of rotation has yet to be achieved. The present invention is viewed as being an improvement over the prior art methods and apparatus in that the control over the azimuth and inclination of a curved wellbore has been achieved and the inherent problems associated with the prior art have been eliminated.

SUMMARY OF THE INVENTION

It is a feature of the present invention to provide for a short-radius lateral drilling system that is capable of drilling a consistent radius of curvature and drilling the curve in the desired direction. The present invention is designed to overcome the problems associated with the prior art methods and apparatus for lateral drainhole drilling; i.e., the tendency for the prior art to drill inconsistent radius of curvatures; the tendency for the prior art to lose the desired orientation of the deflection sleeve and the inability to accurately determine said direction and correct for errors; and the weakness of the flexible joint with the associated tendency of this joint to fail under normal operating conditions.

The present invention employs at least one novel eccentric member with retractable sidewall engaging means that attaches to the downhole end of the flexible drilling string directly over the flexible joint leading to the drill bit collar. The presence of the eccentric member or collar forces the drill bit string passing therethrough to one side of the well bore, thus lever arming the drill bit to the other side of the well bore by pivoting of the drill bit. The presence of the retractable sidewall engaging means prevents the eccentric collar from rotating (in conjunction with the grooved and arched sleeve opposite the compression pad) in the well bore, thus resulting in a tightly curved well bore or short radius of curvature with essentially no change in the azimuth; i.e., resulting in a consistent radius of curvature without substantial doglegs.

Thus, the present invention provides a drilling apparatus for lateral drilling comprising:

(a) a flexible drilling string consisting of limber drilling pipe constructed of various composite materials or other standard industry flexible drill pipe;

(b) an eccentric cylindrical collar having a cylindrical hole passing therethrough wherein the central axis of the cylindrical hole is collinear with and displaced radially to one side relative to the central axis of the eccentric collar and wherein the outer surface of the eccentric collar opposite the side toward which the cylindrical hole is displaced is further equipped with a surface activated, pressure controlled, grooved compression pad that extends from its chamber to engage the borehole and in conjunction with the grooved sleeve on the opposite side of the pressure activated compression pad, engages the borehole during rotary drilling, thus preventing the eccentric collar from rotating during drilling and wherein the eccentric collar operatively surrounds a portion of a drill stem section at the lower end of the flexible drilling string, thus allowing the flexible drilling string and drill stem section to revolve in the cylindrical hole during rotary drilling;

(c) a ball and socket joint utilizing four keys and four keyways to connect the eccentric collar rotatably to the drill collar;

(d) a drill bit collar with rotary drill bit operatively attached to the flexible joint.

It is an objective of the present invention to provide a method of consistently and reliably drilling lateral, horizontal drainholes in environmental, oil, gas and injection wells and the like. It is a further object that the lateral drilling be characterized by a relatively short radius of curvature as well as the absence of significant angular or axial deviation (spiral rotation) of the curved portion of the laterally drilled drainhole. It is another object of the present invention to provide a means for maintaining said curved portion of a laterally drilled drainhole without continuous contact between the well bore and the drill string. Fulfillment of the objects and the presence and fulfillment of additional objects will become apparent upon complete reading of the attached specification and Claims taken in view of the accompanying drawings.

DETAILED DESCRIPTION OF THE PREFERRED EMBODIMENTS

Figure 1A:
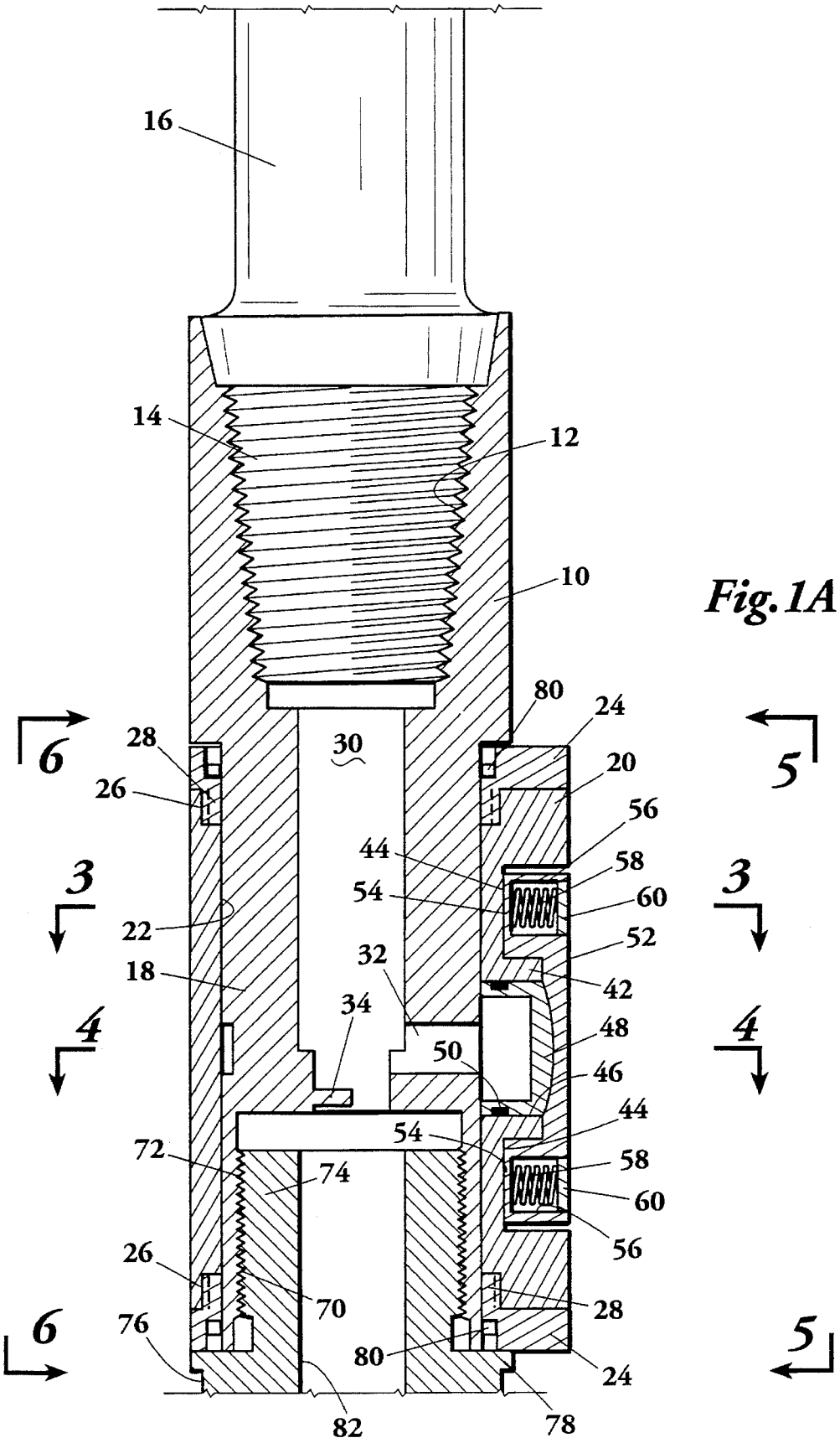
FIGS. 1A and 1B together represent a partial longitudinal sectional view through the lower portion of a drill string showing certain details of the present invention.
Figure 1B:
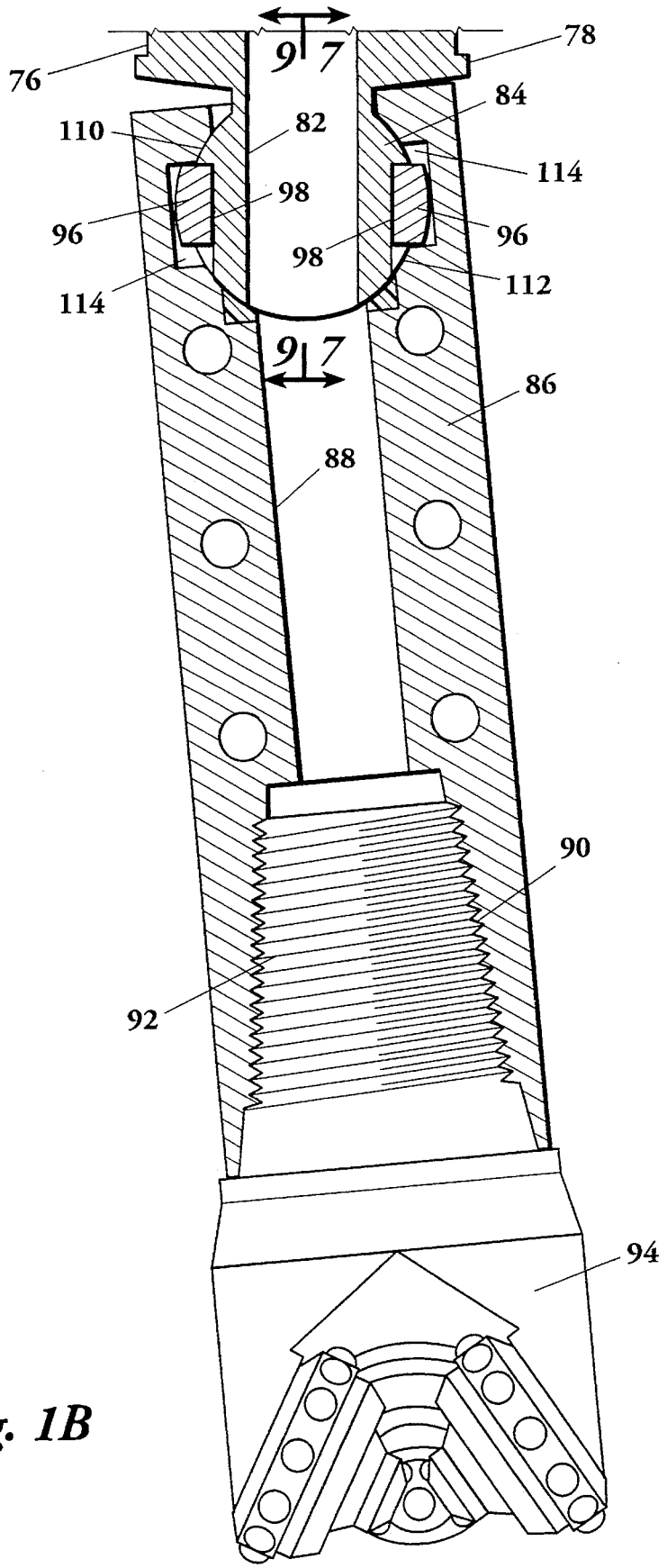

Referring to the drawings in detail, FIGS. 1A and 1B show a drill pipe sub 10 which has been modified and ported in a manner later to be described. The drill sub 10 is provided with female threads 12 which mate with male threads 14 on the lower end of a piece of flexible drill pipe 16. The flexible drill pipe 16 is made of composite materials and is one of a plurality of vertical drill pipes which have been connected together to make a flexible drill string. Below the threaded portion 12, the drill pipe sub 10 is provided with a portion 18 of reduced diameter, but having an outer cylindrical surface on which is received an eccentric cylindrical collar or sleeve 20. The collar 20 has an outer diameter which exceeds the diameter of the upper portion of the drill pipe sub 10, but which has a hole or bore 22 which is offset from the central cylindrical axis of the cylindrical collar 20 itself. The hole 22, however, has a diameter equal to the outer diameter of the reduced portion 18 of the pipe sub 10. Thus, the eccentric collar 20 can rotate around the portion 18 of the pipe sub 10 in a manner similar to that of a cam. Bronze bushings 24 are located at the upper and lower ends of the eccentric collar 20. In this regard, the upper and lower ends of the bore 22 of the collar 20 are provided with cylindrical recesses 26. The bushings 24 are provided with sleeve projections 28 which are received in recesses 26. The bushings 24 are shaped to correspond with the shape of the ends of the eccentric collar 20; that is, the outer circumferences of the bushings 24 are the same as the outer circumference of the eccentric collar 20; likewise, the bushings 24 have central bores therethrough which are offset from the outer diameters of the bushings 24 in the same manner that the bore 22 is offset with respect to the central cylindrical axis of the collar 20. In any event, the internal bores or surfaces of the bronze bushings 24 provide bearing surfaces for the drill pipe sub 10 to rotate inside the eccentric collar 20.

The drill pipe sub 10 is provided with a central bore which is in communication with a central bore (not shown) in the flexible drill pipe 16; all of the drill pipes of the drill pipe string have central bores which are connected to each other and, therefore, the central bore 30 of the drill pipe sub 10 is in communication with the surface for a purpose which will hereinafter appear. The central bore 30 of the drill pipe sub 10 is provided with a radial port 32 which extends horizontally through the reduced portion 18 and is in communication with the eccentric collar 20 for a purpose which will hereinafter appear. Also, the lower portion of the bore 30 is provided with an inwardly radially projecting key 34 for the purpose of aligning and triggering a survey tool (not shown). The key 34 is aligned with engaging locks (not shown) for the purpose of tool face orientation.

As indicated heretofore, the eccentric collar 20, when it rotates relative to the drill pipe sub 10, behaves as a cam. It is further noted that the bore 22 in the eccentric collar 20 is offset from the vertical cylindrical axis of this member. Referring to FIG. 1A, the collar 20, in cross-section, shows a thin portion at the left and a fat or thick portion at the right; the thick portion can also be referred to as the cam portion. The outer left hand portion of the collar 20 appears in FIG. 6 and this portion is provided with vertical grooves 40 which will assist in preventing rotation of the collar 20 in a manner later to be described. The right central (thick) portion of the eccentric collar 20 (as it appears in FIG. 1A) is cut out to form a central boss 42 which projects outwardly between a pair of flat recesses or tracks 44. The boss 42 is provided with a horizontal cylindrical chamber or bore 46 which is in communication with the port 32. The cylindrical chamber 46 is coaxial with the port 32 but somewhat larger than the port 32.

Within the cylindrical chamber 36 is mounted a piston 48. The piston is adapted to slide outwardly and inwardly within the bore 46 in a manner later to be described. The curved exterior of the piston 48 is maintained in sealing relation with the chamber 46 by means of an O-ring 50. A compression pad 52 is mounted over the boss 42 and the piston 48. The compression pad is provided with a pair of horizontal legs 54 which are received in the recesses or tracks 44. The legs 54 are provided with horizontal slots 56 which extend for the full length of the legs parallel to the slots 44. Each interior slot 56 will receive a spring 58, and a restraining strap 60 is positioned in the outer right hand portion of each slot 56 so as to overlie the springs 58.

Figure 3:
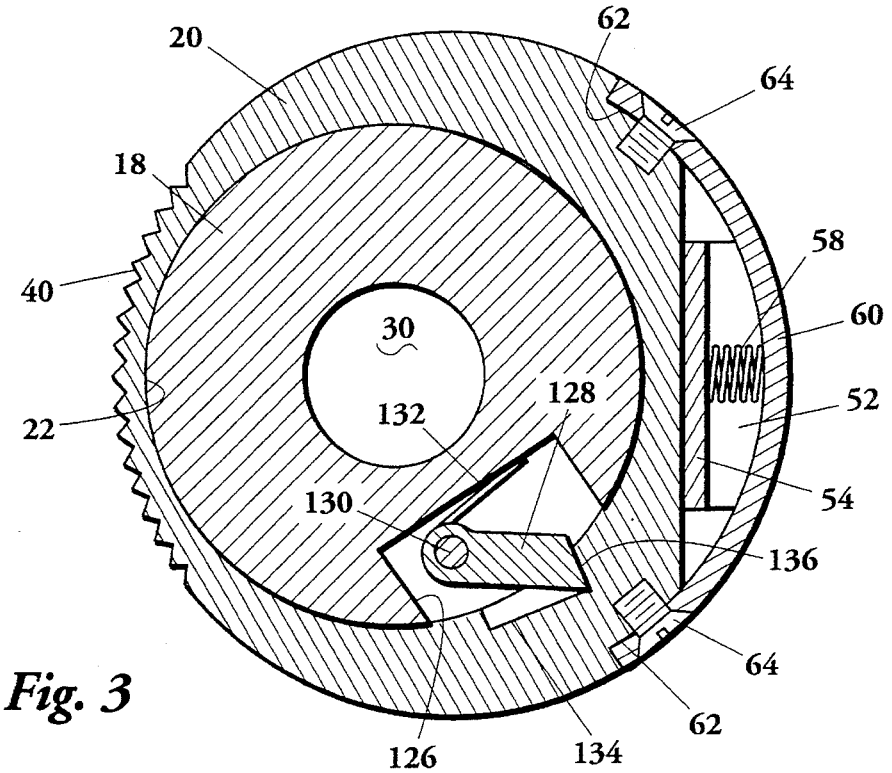
FIG. 3 is a transverse sectional view taken along section line 3—3 of FIG. 1A.
Figure 5:
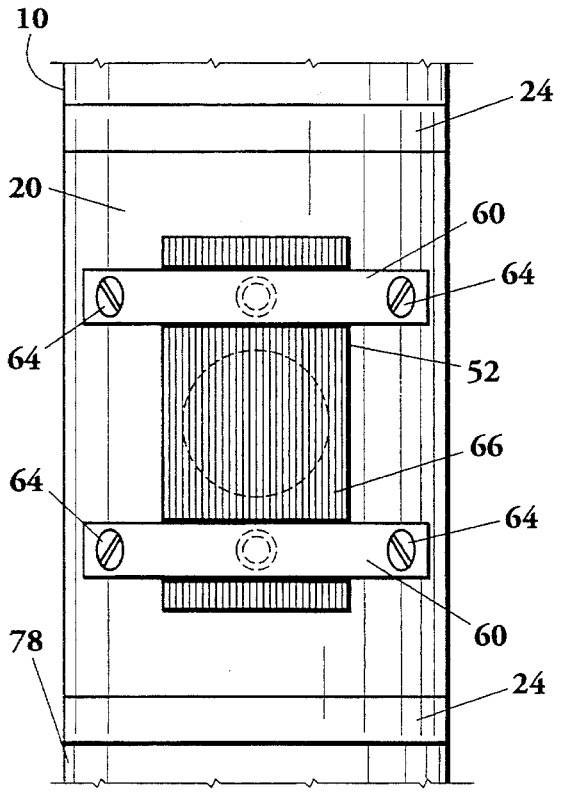
FIG. 5 is a partial side elevational view, as it would appear looking along line 5—5 of FIG. 1A, of the retractable compression pad and its means of attachment to the eccentric collar

As shown in FIGS. 3 and 5 the ends of the straps 60 are received in recesses 62 and held firmly in place by means of screws 64. Also, as best shown in FIG. 5, the exterior surface of the compression pad 52 is provided with grooves 66 similar to the grooves 40 shown in FIG. 6.

Figure 4:
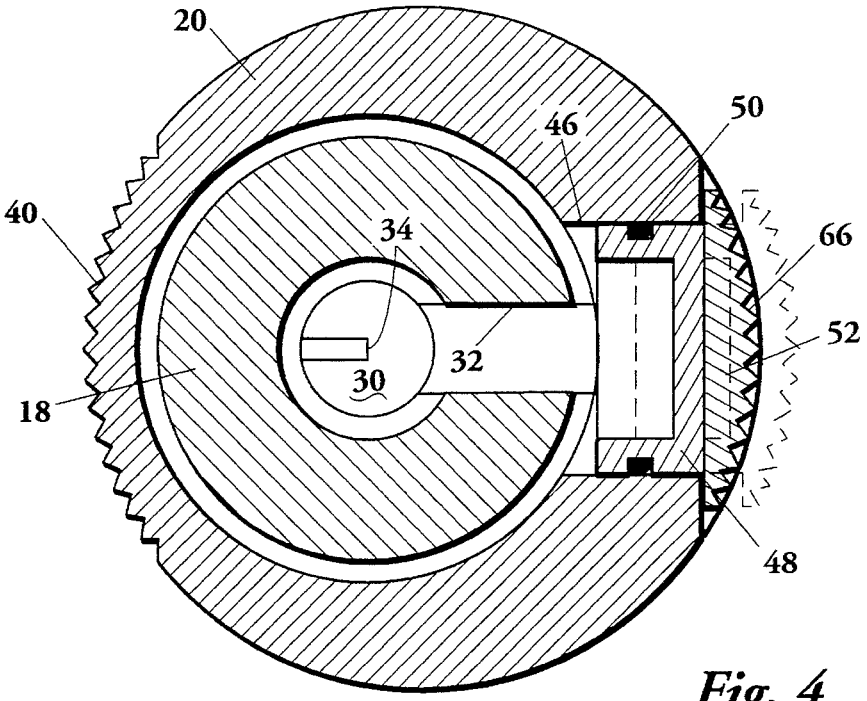
FIG. 4 is a transverse sectional view taken along section line 4—4 of FIG. 1A.
Figure 14A:
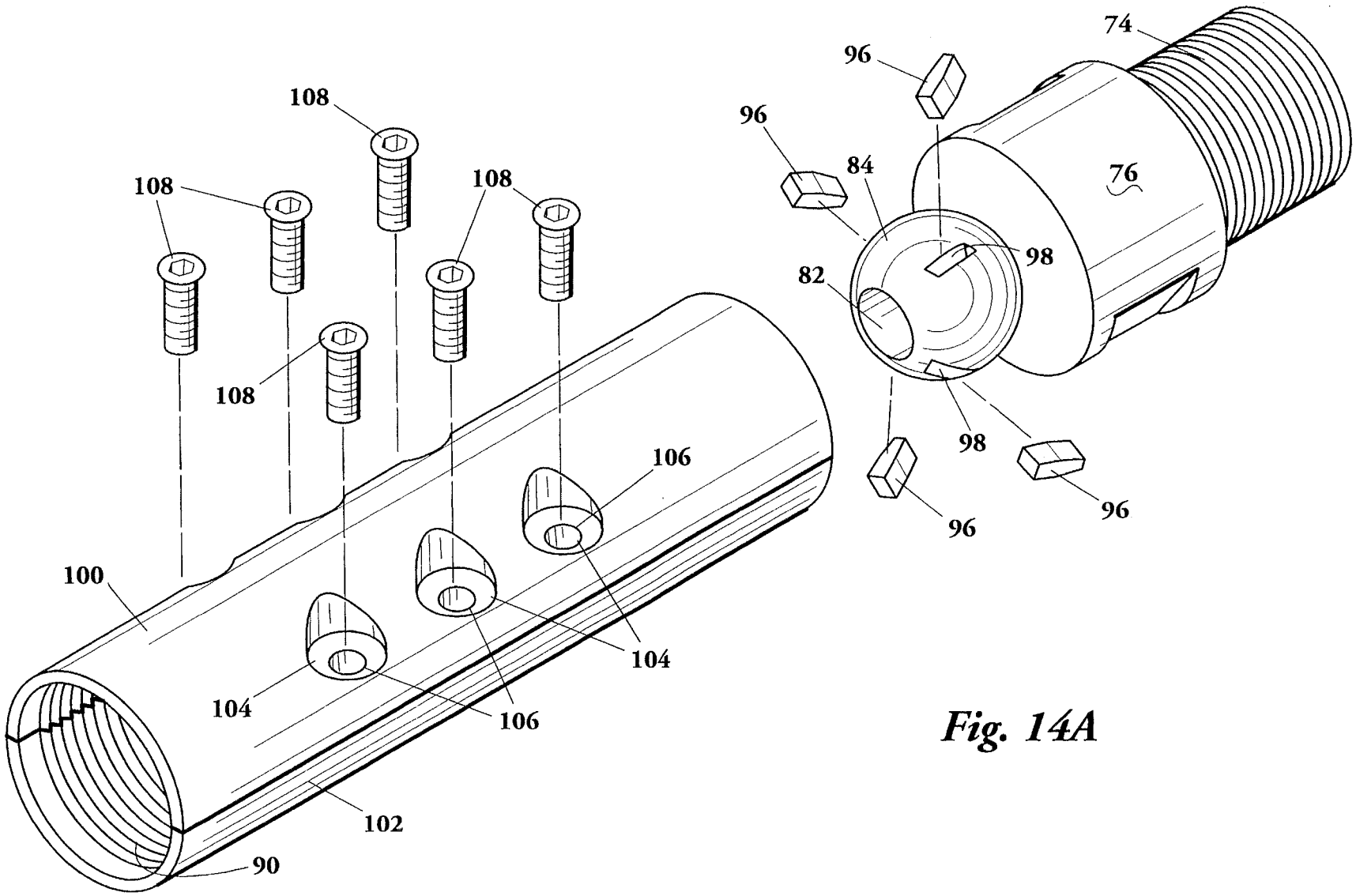
FIGS. 14A, 14B and 14C together represent an exploded view of the device of the present invention.
Figure 14B:
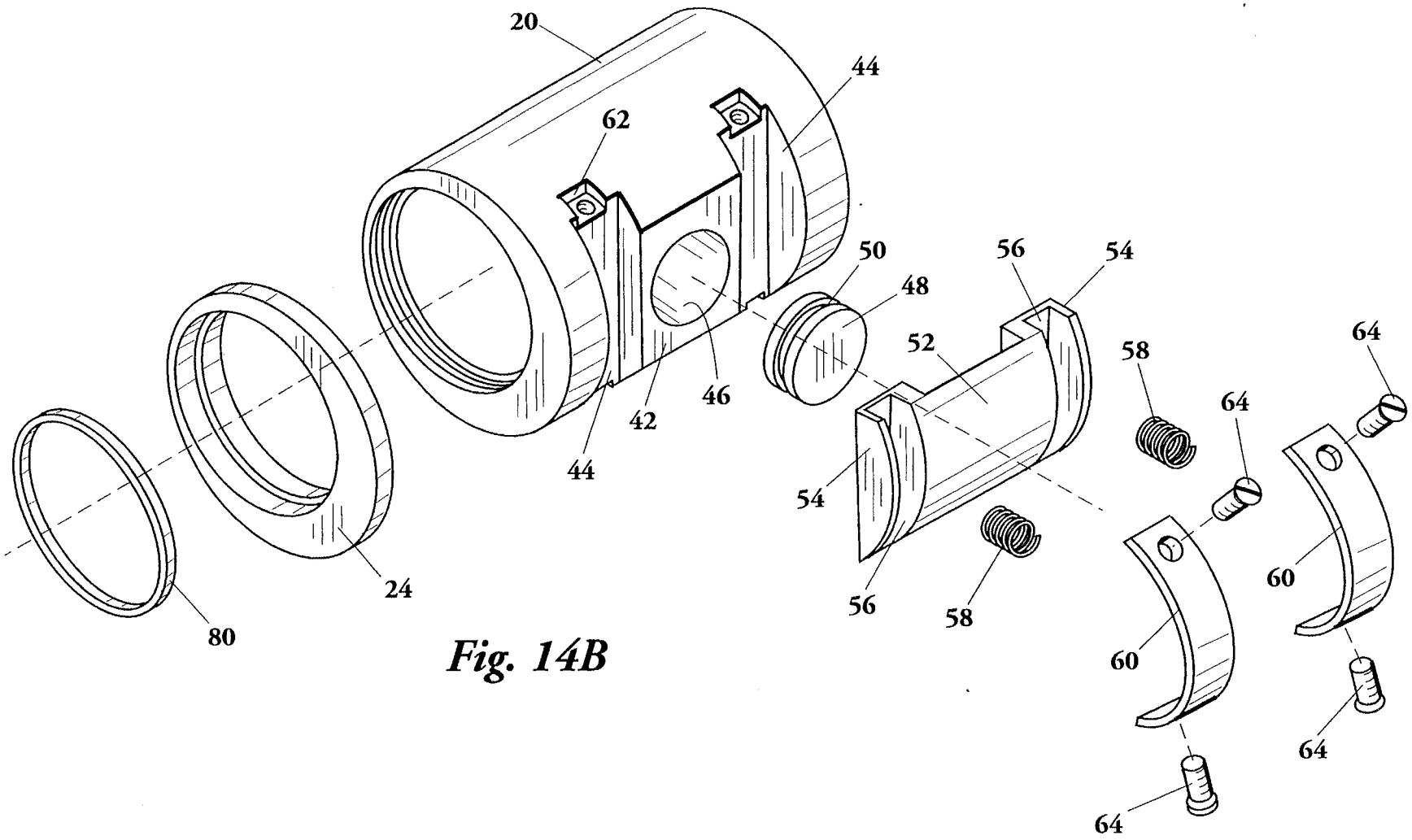

The compression pad 52 is mounted to the exterior of the eccentric collar 20 by means of the boss 42 and the slots or recesses 44 above and below the boss 42. The compression pad 52 has legs 54 that are received in the recesses 44. The outer curved surface of the compression pad 52 conforms generally to the shape of the collar 20. The boss 42 and the recesses 44 and associated structure on the collar 20 can be generally considered as a compression pad chamber to which, or in which, the compression pad 52 is mounted. As best shown in FIG. 4, the outer surface of the compression pad 52 is provided with grooves 66 which, in the solid line position shown in FIG. 4, fall within the normal curvature of the collar 20 if the cut out portion above the boss and the recesses 44 had not been provided. When the drilling string is pressurized so that the piston 48 forces the compression pad 52 outwardly, the outer periphery of the compression pad 52 then travels beyond the outer periphery of the eccentric collar 20 as shown in dotted lines in FIG. 4. The piston 48 is open at its left hand end so as to be in communication with the horizontal port 32. The right hand end of the piston 48 is closed and bears against the underside of the compression pad 52 between the two legs 54. The straps 60 overlie the recesses 56 in the compression pad 52 as shown in FIG. 1A and 14B. The ends of the strap 60 are secured in the outer surface of the collar 20 by means of screws 64. Springs 58 are received in the slots 56 under the straps 60. Thus, when the drill string is pressurized so as to cause the piston 48 to move outwardly in the cylindrical chamber 46, the piston will move the compression pad 52 radially outward against the action of the springs 58. However, when the pressure in the drill string is released, the springs 58 will force the compression pad and the cylinder 48 back to the solid line position shown in FIG. 4.

Figure 13:
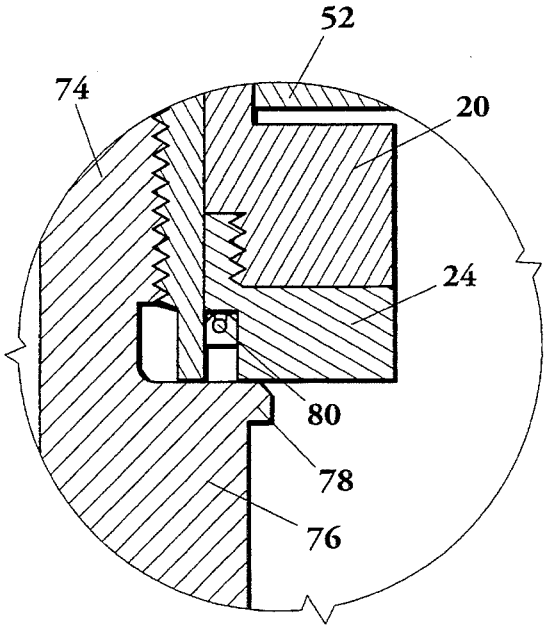
FIG. 13 is a partial longitudinal section view, on an enlarged scale, from the bottom portion of FIG. 1A and showing details of the connections involving the retractable compression pad and associated structure with remaining elements on the lower drill string section.

The lower end of the drill pipe sub 10 is provided with female threads 70 which mate with male threads 72 on the upper portion 74 of a ball shaft 76. The upper portion 74 is of reduced diameter with respect to the main part of the ball shaft 76 and is separated therefrom by means of a flange 78 which projects outwardly so as to be of essentially the same size as the upper portion of the drill pipe sub 10. Thus, the collar 20 is confined between the flange 78 at the lower end and the lip at the upper end which separates the reduced portion 18 from the main portion of the drill pipe sub 10 as best shown in FIG. 13.

Turning now to consideration of FIG. 1B, the ball shaft 76 has a central bore 82 which extends all the way through and communicates at its upper end with the bore 30 of the drill pipe sub 10. The lower end of the ball shaft 76 is provided with a ball 84 which cooperates with a socket, later to be described, at the upper end of a cylindrical adapter 86 which is similar in some respects to the drill pipe sub 10 in that it has a central bore 88 which communicates at its upper end with the bore 82 of the ball shaft 76. The lower end of the adapter 86 is provided with female threads 90 which mate with male threads 92 of a drill bit 94. The drill bit 94 can be a conventional drill bit or any other drill bit which is applicable to the device of the present invention. The drill bit 94 is provided with a bore (not shown) extending through the drill bit and into the area of the cutting teeth for the purpose of introducing a drilling mud, etc.

The ball 84 is provided with four radially outwardly projecting keys 96 which are snugly received (pressure fit) in four keyways 98. The upper internal portion of the adapter 86 is shaped to correspond with the outer shape of the ball 84 and the outwardly projecting keys 96. In order to provide this shape, the adapter 86 is split into two longitudinal sections 100 and 102. As best shown in FIG. 14A, the member 100 is provided with a plurality of recesses 104 in which holes 106 are drilled. Opposite the holes 106, the lower member 102 is provided with threaded openings (not shown). Six threaded screws 108 are adapted to be received in the holes 106 of the recesses 104 and can be screwed down to engage the threaded openings (not shown) in the member 102. Thus, tightening the screws 108 will bring the two parts of the adapter 86 snugly together.

Figure 8:
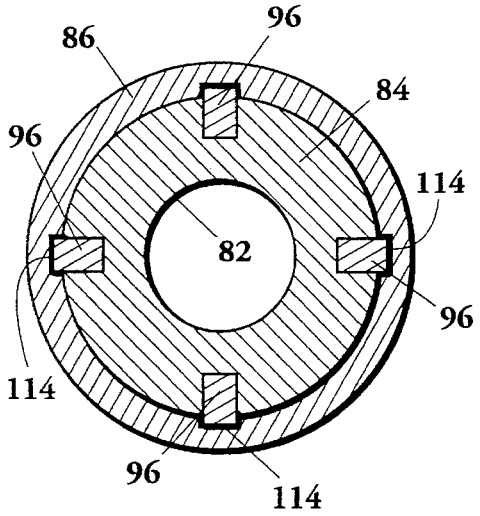
FIG. 8 is a transverse sectional view taken along section line 8—8 of FIG. 7.

The upper end of the bore 88 is enlarged to permit the ball 84 to move from side to side. Also, the interior upper end of the bore 88 is provided with curved portions 110 and 112 so as to conform with the outer shape of the ball 84. Between the curved portions 110 and 112, the adapter 86 is provided with four keyways or recesses 114 (see also FIG. 8) which, as shown in FIGS. 1B, 7, 9 and 10, have a vertical dimension which is greater than the vertical dimension of the keys 96 to permit tilting of the ball 84 in relation to the adapter 86.

Figure 7:
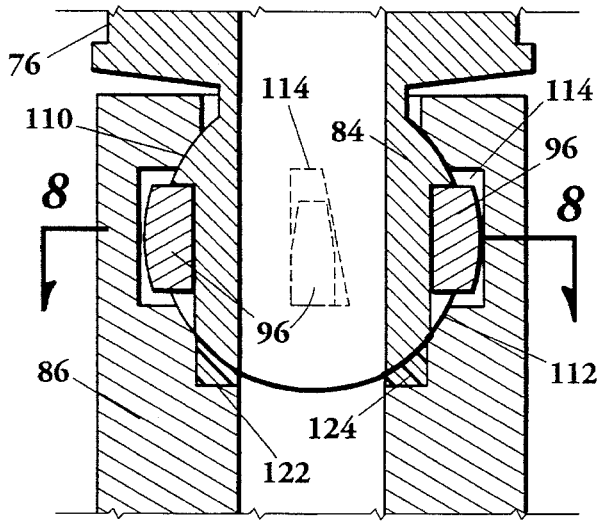
FIG. 7 is a partial longitudinal section view taken along section line 7—7 of FIG. 1B, on a slightly enlarged scale, showing further details of the ball and socket arrangement including the keys mounted in the keyways.
Figure 11:
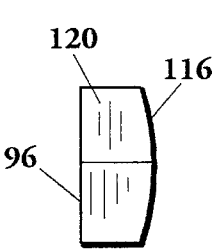
FIG. 11 is a front elevation of one of the keys shown in FIG. 7.
Figure 12:
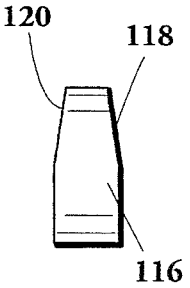
FIG. 12 is an end view of the key shown in FIG. 11.

Each key 96 (see FIGS. 11 and 12) has an outer curvature 116. The part of the key which is inserted into the keyway 98 of the ball 84 is tapered convergingly upward, as best shown in FIG. 12, to provide two surfaces 118 and 120 which are tapered approximately 6° each with respect to the vertical. The keyways 114 in the adapter 86 are shaped in the form of a trapezoid, as best shown in FIG. 7. Below the curved portion 112 there is a recess 122 for receiving therein an O-ring 124.

FIG. 1B shows the adapter 86 tilted to the right with respect to the ball shaft 76; that is, the lower end of the adapter upon which the drill bit 94 is mounted is moved to the right with respect to the upper end of the adapter 86. With respect to the right hand key shown in FIG. 1B, this has now moved to the bottom of the keyway 114 to the right in the adapter 86; conversely, the left hand key 96 has moved to the upper end of the left hand keyway 114 in the adapter 86. FIG. 7 is a sectional view, on a slightly larger scale, taken along section line 7—7 of FIG. 1B and the right hand key 96 shown in FIG. 1B is now in dotted lines in the center of the figure. The key 96 to the right in FIG. 7 would be the key that is closest to the reader in FIG. 1B and the key 96 which is to the left in FIG. 7 would be the key to the rear for the reader of FIG. 1B. Since the adapter 86 is tilted in one direction only, the two keys 96 shown in FIG. 7 are located midway in the recesses 114 of FIG. 7.

Figure 10:
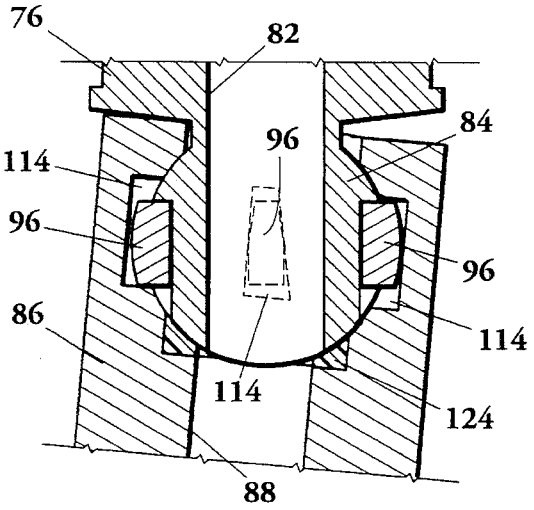
FIG. 10 is a partial longitudinal sectional view taken along section line 10—10 of FIG. 9.
Figure 9:
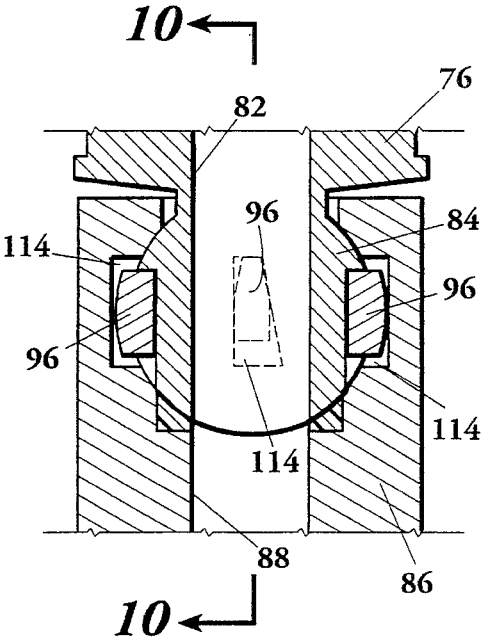
FIG. 9 is a partial longitudinal sectional view similar to FIG. 7 but taken along a section line 9—9 of FIG. 1B.

FIG. 9 is a view taken along section line 9—9 of FIG. 1B opposite to the direction of FIG. 7. In FIG. 9, the key 96 and keyway 114 shown in dotted lines in the center of the Figure represent the key 96 and the keyway 114 shown to the left in FIG. 1B; this Figure confirms the fact that the key 96 is at its uppermost position in the slot 114 as shown in FIG. 1B. FIG. 10 is a view taken along section line 10—10 of FIG. 9 and shows the exact opposite of what is shown in FIG. 1B; for example, the key 96 shown to the right in FIG. 10 is the same as the key 96 shown at the left of FIG. 1B.

Turning briefly to FIG. 4, this is a representation of what happens when pressure is exerted through the channel or port 32 against the piston 48 which rides against the compression pad 66. Absent any pressure, the compression pad will occupy the solid line position shown in FIG. 4; however, when pressure is exerted through the port 32, the compression pad will move to the dotted line position shown in this figure.

Figure 14C:
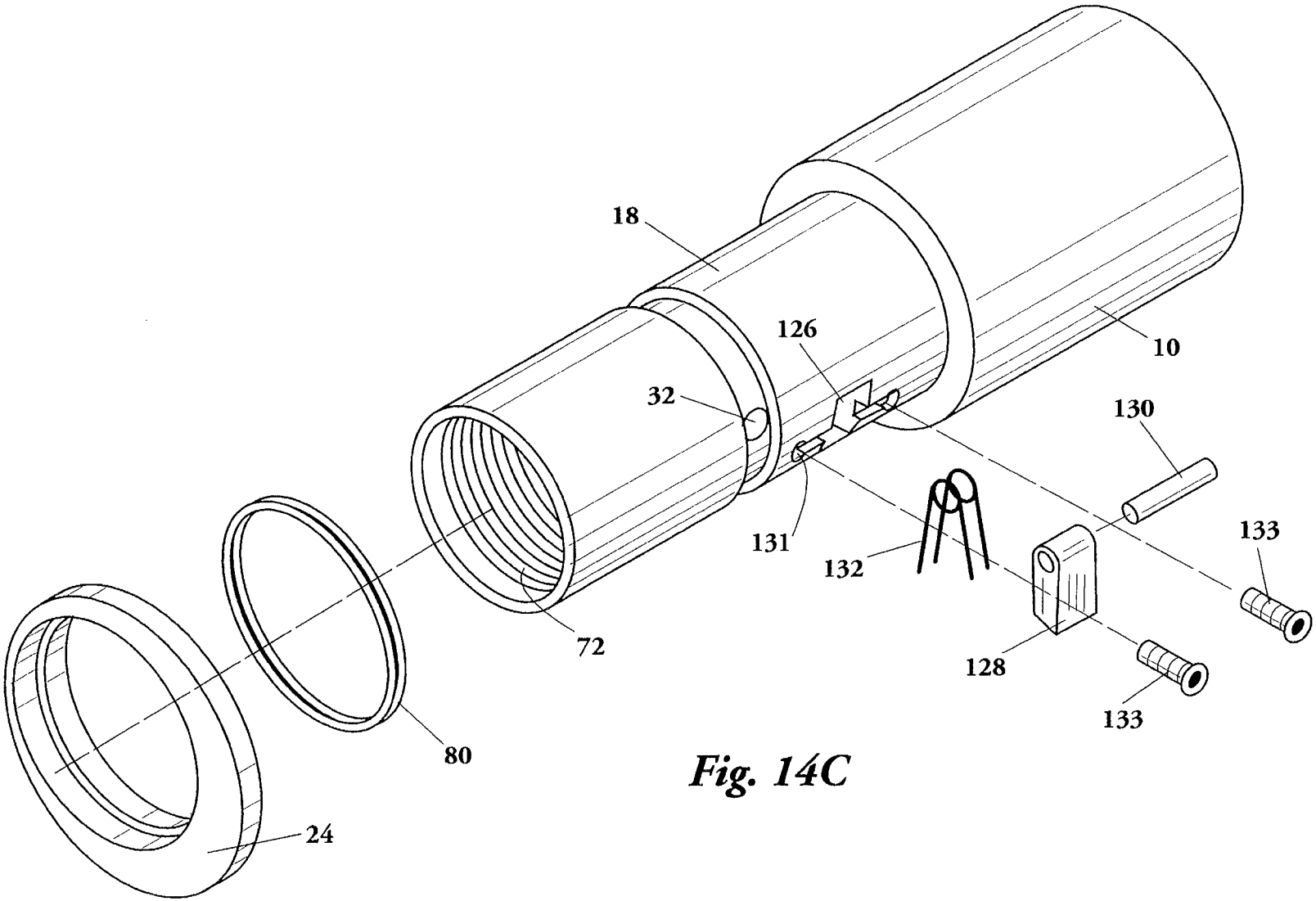

Turning now to FIG. 3, this figure shows a means whereby the eccentric collar 20 can be turned when the drill string is rotated in a counter-clockwise direction or, conversely, why the collar does not turn when the drill string is rotated in a clockwise direction. The reduced portion 18 of the drill pipe sub 10 is provided with a rectangular recess 126 in which a pawl or lug 128 is received. The end of the pawl is pivotally mounted on a pin 130 which is received in a suitable slot 131 and held in place by screws 133 (see FIG. 14C). A wire spring 132 is received on the pin 130. A portion of the spring 132 bears against the inside portion of the recess 126, as shown in FIG. 3, and the other part of the spring bears against the pawl 128 to urge the pawl radially outward around the pin 130. The collar 120 is provided with a tapered recess 134, one end of which ends in a shoulder 136. When the drill string is rotating in a clockwise direction, as would be normally the case, the member 18 shown in FIG. 3 would be also rotating in a clockwise direction so as to carry the pawl 128 in a clockwise direction out of the recess 134 and continuing around until it again falls into the recess 134, but continued rotation of the member 18 in a clockwise direction will cause the pawl 128 to alternately drop into the recess 134 and alternately be pulled out of it as the member 18 rotates. However, if the drill string should be rotated in a counter-clockwise direction, referring to FIG. 3, the member 18 would also be moving in a counter-clockwise direction so that the pawl 128 would now be received fully within the recess 134 and the end of the pawl would bear against the shoulder 136 so as to attempt to turn the eccentric collar 20 in a counter-clockwise direction.

The bronze bearings 24 seated at the top and bottom of the eccentric collar support the sleeve on the drill pipe sub 10 and provide a bearing surface for the eccentric collar on which to rotate when secured to the drill pipe sub. The eccentric collar however is able to resist the rotational torque during the drilling of the rotatable drill sub in a clockwise direction as the sleeve is held stationary in part by the compression pad while the compression pad engages the well bore. The O-ring 80 inserted in the bronze bearings provides a seal to prevent leakage of the drilling fluid between the drill pipe sub and the eccentric collar.

Figure 6:
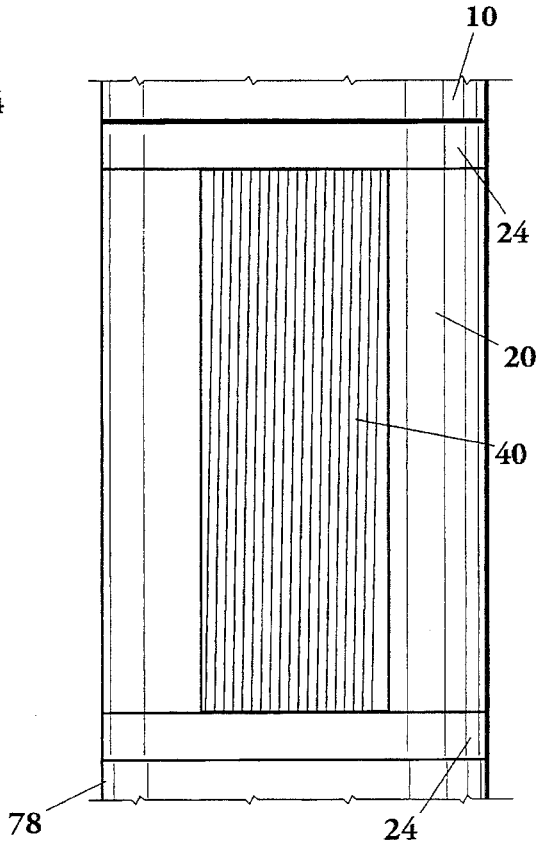
FIG. 6 is a partial side elevation looking at the eccentric collar from the opposite side as compared to FIG. 5 and showing the vertical grooves opposite from the compression pad.

The thin side of the eccentric collar (opposite from the compression pad) is shaped and grooved as in FIG. 3 and as also shown in FIG. 6. This side has vertical grooves 40 in order to stabilize and prevent the eccentric collar from rotating when the compression pad is activated causing the opposite side and the compression pad (thick) side to be compressed against the sides of the bore hole. The vertical grooves 40 engage the back side of the well bore thus helping to prevent rotation of the eccentric collar while the drill pipe sub is rotating within. However, grooves 66 on the compression pad as seen in FIG. 5 provide an essential element which prevents rotation of the eccentric collar. It is the combination of the two sets of grooves 40 and 66, working together, which prevents the eccentric collar from rotating when fluid pump pressure is applied to the compression pad. This causes the compression pad to be forced against the side of the hole and in turn forces the drill pipe sub and eccentric collar to the opposite side of the well bore. The two sets of grooves 40 and 66 on the eccentric collar and compression pad then dig into each side and prevent the eccentric collar from rotating.

The compression pad 52 is unique over the prior art because of the amount of grooved surface available to engage the side of the well bore. The grooved face of the compression pad of this invention has been found to be the most efficient device for grabbing the side of a well bore. The grooves 66 and 40 are oriented in a vertical direction and slighted canted to the left (see FIG. 6 where the lower ends of the grooved 40 are canted to the left in relation to the tops of these grooves). The canting of the grooves, in effect, counters the rotational effect of the drill pipe sub because of the compression pad's left hand spiral. The purpose of this is to maintain a cleaner curve while drilling by offsetting the tendency of the eccentric collar to pull to the right because of the friction between the bearings in the eccentric collar and the surface of the drill pipe sub whereupon they rotate. In addition to the vertical grooves on the face of the pad, there is a second set of vertical grooves on the back side or side of the eccentric collar opposite from the compression pad. These grooves are also canted to the left, also helping to pull the cam sleeve to the left as it follows the bit down the hole during the drilling process. By grooving both the compression pad face and the back side of the eccentric collar, the drilling tool is better able to secure itself to the well bore when the compression pad is activated, thus drilling a more planar curve.

Figure 2:
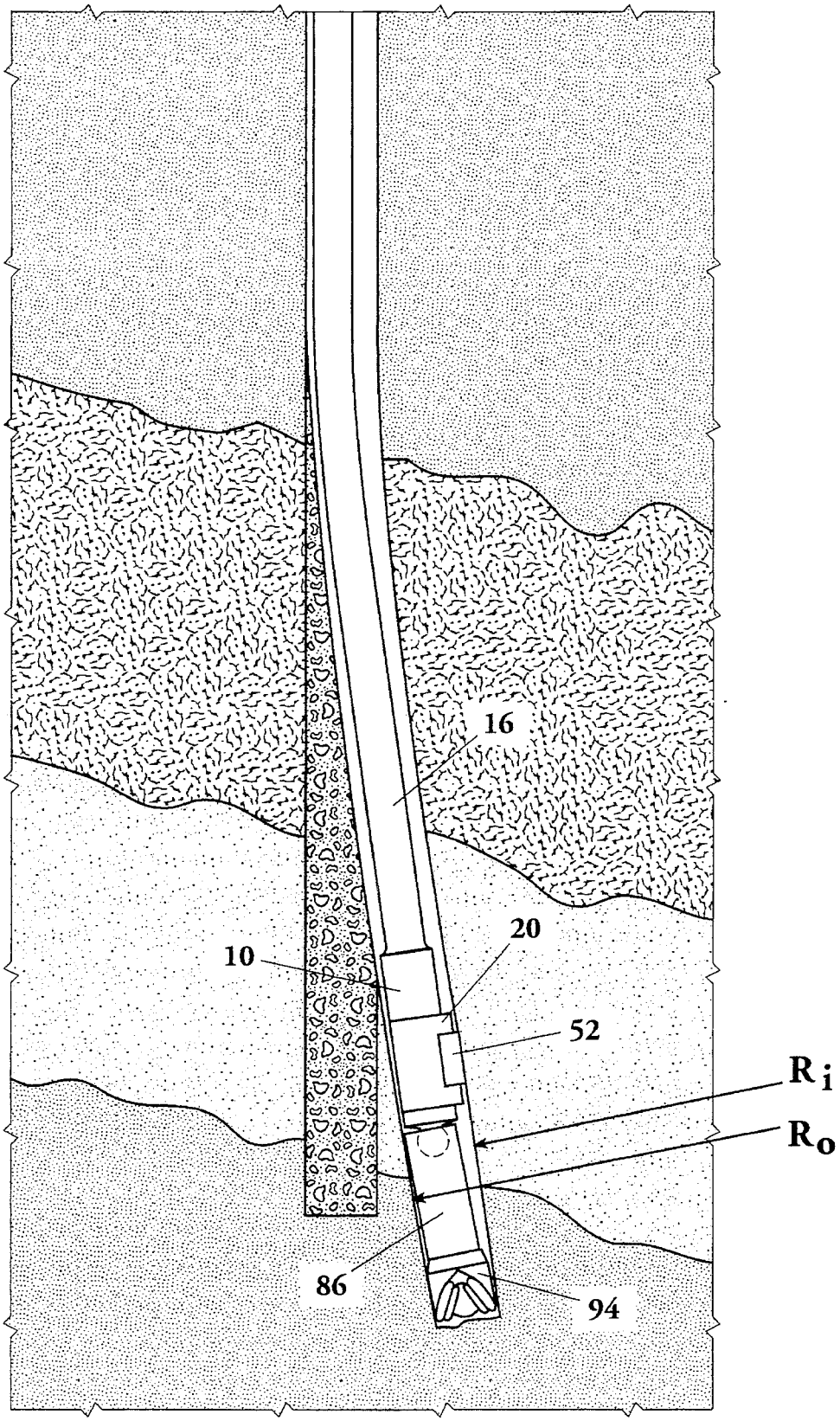
FIG. 2 is a semi-diagrammatic representation of a drill string employing the present invention on the lower portion thereof, showing the lower end of a plugged up well bore and showing the device of the present invention as it commences to drill on a deviant path from the original well bore.

FIG. 2 shows the tool 10 of the present invention at the lower end of a well bore where curved drilling has already commenced. The curved borehole has an outside radius Ro and inside radius Ri. When the compression pad 52 is expanded it contacts the borehole at the inside radius Ri and forces the drill pipe sub 10 towards the outside radius Ro. This causes the drill bit 14 and the adapter 86 to pivot around the ball joint.

When drilling a well bore with the tool of the present invention, it will be first assumed that the eccentric cylindrical collar has been previously positioned in the proper location and that the drilling assembly is pressurized and rotating clockwise in the drilling mode. It would be further assumed that weight is on the drill bit so that the bit can do its job of drilling. Since the eccentric cylindrical collar will be pushing against one side of the well bore, the upper end of the adapter will be moved towards the opposite side of the well bore and the drill bit and adapter will be tilted slightly such that the drill bit is drilling along a curved path. As the drill bit continues to drill downwardly, the eccentric collar will move downwardly in sliding relation to the side of the well bore. The grooves on the compression pad and on the opposite side of the eccentric collar will prevent the collar from rotating.

Later, if it is desired to reposition the drilling assembly within the borehole, the drill bit is first lifted off the bottom of the borehole, the pump pressure is increased to insure that the compression pad is pushed against the side of the borehole, the drilling assembly is then rotated in the non-drilling mode until the lug in the drilling pipe sub engages the shoulder in the eccentric collar. When the lug is in engagement with the eccentric collar, the pump pressure is decreased so as to retract the piston and the compression pad. The drilling assembly is now rotated in the nondrilling direction until the compression pad is pointed in the desired orientation. Thereafter, the drilling apparatus is lowered to place the drill bit on the bottom of the borehole. At this time, the pump pressure is increased to activate the piston and the compression pad so as to urge the latter into contact with the side of the well bore. Thereafter, the drilling apparatus can be rotated in the drilling direction and the drilling will proceed as before.

Whereas, the present invention has been described in particular relation to the drawings attached hereto, other and further modifications, apart from those shown or suggested herein, may be made within the spirit and scope of this invention.

What is claimed is:

1. In a drilling assembly of interconnecting generally tubular elements descending in a flexible alignment; the drilling assembly having a central opening descending therethrough capable of having fluid under pressure pumped therethrough during the drilling operation, the drilling assembly being capable of providing a rotatable torque for rotatably drilling a curved lateral borehole from an existing main borehole by means of a terminal drill bit, a drilling tool for drilling a curved borehole comprising:

a drill pipe sub having an upper section and a lower section with a central opening descending therethrough, the upper section rotatably connected to the drilling assembly and the lower section having a horizontal port connected to the central opening, an eccentric cylindrical collar rotatably and sealably mounted about the lower section of the drill pipe sub, the eccentric collar having a thick side and an opposite thin side, the thick side having a horizontal cylindrical piston bore communicating with the horizontal port in the lower section of the drill pipe sub, a piston mounted for sliding within the piston bore, a retractable compression pad mounted on the thick side over the piston and movable outwardly by the piston, wherein the piston and compression pad are capable of being activated by fluid under pressure passing through the horizontal port opening into the piston bore so that the retractable compression pad is pushed outwardly by the piston against the borehole and wherein the thin side of the collar is pushed simultaneously against the opposite side of the borehole to secure the collar from rotating and wherein the piston and compression pad are capable of being deactivated and of being retracted by decreasing the fluid pressure.

2. A drilling tool according to claim 1 wherein retraction springs urge the compression pad towards the eccentric collar, the springs retracting the compression pad against the eccentric collar when the fluid pressure is reduced.

3. A drilling tool according to claim 2 the compression pad has an outer surface which encompasses a plurality of vertical grooves canted which grooves are capable of engaging the borehole wall.

4. A drilling tool according to claim 3 wherein the eccentric collar is provided with a thin side opposite the compression pad and wherein the thin side is provided with an outer surface which encompasses a plurality of canted vertical grooves which are capable of engaging the borehole wall and moving down the borehole during the drilling.

5. A drilling tool according to claim 1 wherein the eccentric collar is seated upright within upper and a lower bearing rings circumferentially mounted on the lower section of the drill pipe sub, the bearing rings supporting the eccentric collar for rotation around the drill pipe sub.

6. A drilling tool according to claim 5 wherein O-rings are circumferentially mounted between the bearing rings and the drill pipe sub, the O-rings sealing the bearing rings to the drill pipe sub.

7. A drilling tool according to claim 1 wherein a spring loaded rectangular engaging lug having a beveled outer surface is mounted in the drill pipe sub, said lug engaging the inner surface of the eccentric collar to lock the eccentric collar to the drill pipe sub only when the drilling assembly is turned counter-clockwise in a nondrilling mode.

8. A drilling tool according to claim 7 wherein an orientation key is mounted within the interior of the drill pipe sub protruding into its central opening aligned with the engaging lugs, which orientation key is capable of triggering a survey tool instrument to determine tool face orientation.

9. A drilling tool according to claim 1 including a ball shaft, the ball shaft having an upper threaded portion which mates with a lower threaded portion on the lower section of the drill pipe sub so as to be rotatable with the drill pipe sub, a ball mounted on a lower end of the ball shaft, a cylindrical adapter having a socket at the upper end thereof providing driving engagement with the ball and simultaneously permitting pivotal movement between the adapter and the ball shaft, the adapter having a threaded portion at a lower end thereof for receiving therein the terminal drill bit.

10. A drilling tool according to claim 9 wherein the ball is provided with a plurality of circumferentially spaced keyways in which are received a plurality of keys, the keys being pressure fit into the keyways in the ball, the keys projecting radially outward from the ball beyond the keyways therein, the upper end of the adapter being provided with curved portions to correspond with the shape of the ball and also being provided with a second plurality of keyways in which the keys are received so that the ball is in driving relation with the adapter through the keys which contact the keyways in the adapter.

11. A drilling tool according to claim 10 wherein the keyways in the adapter have a vertical dimension greater than the vertical dimension of the keys and wherein the cross-sectional shape of the keyways in the adapter are trapezoidal.

12. A drilling tool according to claim 1 wherein the thick side of the eccentric collar is cut away to provide a compression pad chamber, the central portion of the compression pad chamber having a boss which projects radially outward from the eccentric collar to the center of the compression pad chamber, the boss having therein the horizontal piston bore in which the piston is mounted for sliding movement, the compression pad chamber being provided with horizontal recesses above and below the boss, the compression pad being provided with a pair of legs received within the horizontal recesses, the legs being provided with horizontal slots which extend for the full lengths of the legs, a compression spring mounted within each slot and a restraining strap received in the outer portion of each slot overlying the springs, the ends of the straps being secured to the side of the eccentric collar, whereby, when pressure is introduced into the drilling assembly, the piston will move outwardly in the piston bore within the boss against the compression pad to move the compression pad outwardly with respect to the compression pad chamber while the springs in the slots are simultaneously compressed against the straps; and whereby, when the pressure is removed from the drilling assembly, the springs will force the compression pad and the piston inwardly with respect to the eccentric collar.

13. A drilling tool according to claim 12 wherein the compression pad has an outer surface which encompasses a plurality of canted vertical grooves which are capable of engaging the borehole wall.

14. A drilling tool according to claim 13 wherein the eccentric collar is provided with a thin side opposite the compression pad and wherein the thin side is provided with an outer surface which encompasses a plurality of canted vertical grooves which are capable of engaging the borehole wall and moving down the borehole during the drilling.

15. A method for drilling a curved lateral borehole from an existing main borehole by means of drilling assembly having a drill string transmitting rotational torque sequentially to a lower borehole drilling tool which in turn is connected by a flexible joint to a terminal drill bit and wherein fluid under pressure is pumped through a central opening in the drilling assembly during the drilling comprising:

providing a borehole drilling tool which includes an eccentric collar rotatably mounted circumferentially about a drill pipe sub and having a horizontal opening extending outwardly from the central opening, the horizontal opening being in sealed alignment with a piston activated radial extending and retractable compression pad on a cammed side of the eccentric collar, drilling the curved borehole while pumping fluid under pressure through the central opening in the drilling assembly such that the fluid passes through the horizontal opening and engages the piston, thus forcing the compression pad outwardly against the borehole wall causing the drilling tool to be displaced to a side of the borehole, while simultaneously pressing a side of the eccentric collar opposite from the cammed side against a side of the borehole wall, thus preventing the eccentric collar from rotating during the rotational drilling, thereafter reducing the fluid pressure, after a period of drilling, so as to disengage the compression pad from the borehole wall and retract the piston and compression pad into their deactivated positions, and then moving the drilling tool as required.

16. A process according to claim 15 for repositioning the drilling assembly within the borehole to another position comprising lifting the drill bit off the bottom of the borehole, increasing the pump pressure to resume the flow of liquid under pressure thus activating the piston and pushing the compression pad against the side of the borehole, slowly rotating the drill assembly in a nondrilling direction until the eccentric collar is locked to the drill pipe sub by engaging lugs, then stopping the rotation of the apparatus, decreasing the pump pressure thus retracting the piston and compression pad into their deactivated positions, rotating the drill assembly in the nondrilling direction until the compression pad is pointed in a desired drilling direction, lowering the drilling apparatus and drill bit to the bottom of the borehole, increasing the pump pressure to provide the hydraulic pressure required to activate the piston and compression pad, rotating the drilling apparatus in the drilling direction and continue drilling.

* * * * *